US005465489A

United States Patent [19]

Meek

[11] Patent Number: 5,465,489

[45] Date of Patent: Nov. 14, 1995

[54] TOOL FOR REMOVING HIGHWAY LANE MARKING TABS

[76] Inventor: Phynes L. Meek, 2151 Halsey Dr., Medford, Oreg. 97504

[21] Appl. No.: 380,491

[22] Filed: Jan. 30, 1995

[51] Int. Cl.[6] ..... A47L 13/08

[52] U.S. Cl. ..... 30/171; 30/315; 15/236.08

[58] Field of Search ..... 30/169, 171, 172, 30/278, 280, 124, 128, 136, 315; 15/236.01, 236.08

[56] References Cited

U.S. PATENT DOCUMENTS

| | | | |
|---|---|---|---|
| 2,299,418 | 10/1942 | Thomas | 30/171 |
| 2,810,193 | 10/1957 | Glodde | 30/280 |
| 3,095,228 | 6/1963 | Duppengiesser | 294/49 |
| 3,818,593 | 6/1974 | Oliverius | 30/169 |
| 4,067,107 | 1/1978 | Scafetta | 30/169 |
| 4,848,816 | 7/1989 | Anderson | 15/236.08 |

*Primary Examiner*—Hwei Siu Payer
*Attorney, Agent, or Firm*—James D. Givnan, Jr.

[57] ABSTRACT

A tool having a base plate for sliding along a roadway surface and defining slots extending rearwardly from a forward edge of the base plate. Each slot has parallel wall surfaces between which a flexible tab to be cut is received and held upright until a cutting edge, at the slot end, severs the tab at roadway surface level. Side walls and a rear wall on the base plate confine severed tabs on the base plate until tab discharge into a receptacle. Blade surfaces on the base plate are inclined downwardly and forwardly. A closure, on a modified form of the tool, may swing open to admit a tab being severed and thereafter close to prevent loss of severed tabs from the tool. A pivotally mounted handle facilitates sliding of the tool along a roadway in surface contact with same. A discharge opening in the rear wall of the modified tool facilitates tab discharge into a receptacle.

5 Claims, 1 Drawing Sheet

TOOL FOR REMOVING HIGHWAY LANE MARKING TABS

BACKGROUND OF THE INVENTION

The present invention pertains generally to a tool for severing tabs used in a temporary manner to denote traffic lanes of newly paved roadways until painting of lane lines or installation of lane markers.

In the paving or resurfacing of a roadway a subsequent period of time will elapse before permanent lines or markers may be applied to denote traffic lanes. Presently used for temporary marking of traffic lanes, prior to striping of same, are plastic tabs, a portion of which is embedded in the newly laid paving material. The tabs must be removed upon the roadway surface being suitably marked in a permanent manner.

Tab removal must be in a manner avoiding damage to the roadway surface which could result in the collection of water and ultimately, over a period, damage to the surface. For this reason, commonly governmental agencies require that such tabs be severed at or slightly above the roadway surface. Cutting of the tabs with a knife has proven to be impractical from a man hour standpoint and is not desirable in that surface damage could result. Contributing to the present problem of tab removal is the contractural requirement that all severed tabs must be removed from the roadway.

U.S. Pat. No. 2,810,193 discloses a tool having a blade for travel along the perimeter of a tire with multiple cutting edges 11 formed thereon for the purpose of removing tire tread remnants. Cutting edges 11 are spaced above the tread surface. U.S. Pat. No. 3,818,593 discloses a tool which may be motor driven with the working member having a series of beveled teeth for the purpose of removing roofing nails in a roof stripping operation. Inclined surfaces of the blade serve to lift a shingle nail. U.S. Pat. No. 3,095,228 discloses an earth working implement defining openings 12 terminating upwardly in rounded edges 16 which may be sharpened to enable the use of the tool in a root cutting or similar operation.

SUMMARY OF THE INVENTION

The present invention is embodied in a tool for severing the lane denoting tabs and collecting the severed tabs for periodic disposal.

A base of the tool includes a leading edge with pairs of rearwardly converging wall segments terminating in pairs of upright walls to receive a tab therebetween and confine same in an upright position prior to and during severing by a blade at the terminus of each pair of said walls. Subsequent to tab separation, the tab moves to a collection area on the base from which the collection may be conveniently discharged. A plurality of cutting edges are preferably provided to permit the user always having access to a sharp cutting edge during a work shift. A modified form of the invention includes enclosure with a pivotally mounted handle to facilitate tool use and emptying of the tool tab collection area. A barrier prevents accidental discharge of severed tabs onto the roadway surface.

Important objectives of the present invention include the provision of a tool for the efficient severing of tabs partially embedded in a roadway permitting rapid tab removal without risk of damage to the paved roadway or requiring a worker to work in an awkward position; the provision of a tool that at all times during a work shift provides a sharp edge by reason of the tool having a multitude of blades; the provision of a tool having a barrier to prevent the loss of severed tabs from a collection area of the tool.

DESCRIPTION OF THE PREFERRED EMBODIMENTS

Figure 1:
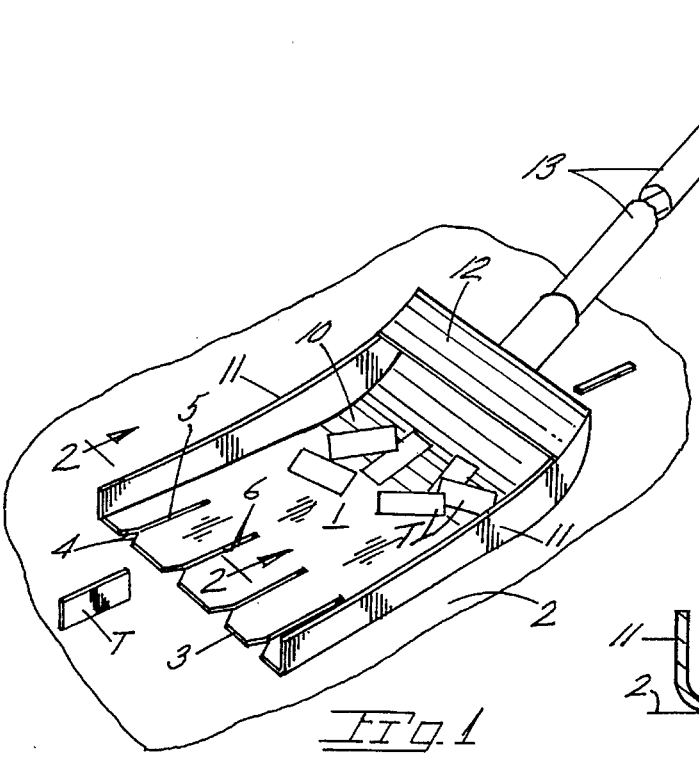
FIG. 1 is a perspective view of the present tool.
Figure 3:
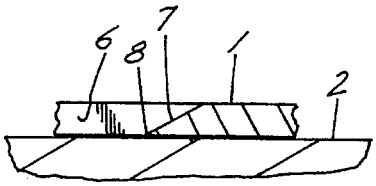
FIG. 3 is a vertical sectional view taken along line 3—3 of FIG. 2.
Figure 2:
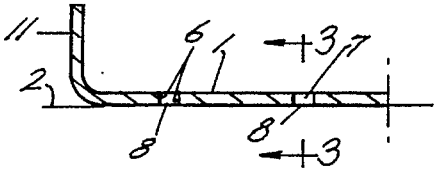
FIG. 2 is a vertical sectional view taken along line 2—2 of FIG. 1.

With continuing attention to the drawings, the reference numeral 1 thereon indicates the base of the present tool in place on a paved roadway surface 2.

A leading edge 3 of the base is interrupted at intervals by pairs of rearwardly converging wall segments 4 with each of said pairs of segments defining an open area or mouth of an expanse several times the thickness of a tab T to be severed.

Slots at 5 are formed by pairs of parallel walls 6 contiguous with segments 4 with the spacing of the walls of each pair being only slightly greater than the thickness of tab T and which serve to confine the tab upright as the pair of walls 6 move therepast in a tab removing effort.

A blade 7 defines the end of each slot 5 and has a cutting edge 8 and formed so as to, during cutting of the tab, urge base 1 of the tool downwardly into flush sliding contact with the roadway. As the tabs are semi-rigid in nature the tab end imparts a downward force on the blade 7. Each tab is accordingly severed close to the roadway surface without risk of disturbing the newly laid paving material. Advancement of the tool results in a severed tab coming to rest in the collection area 10 of the tool which is periodically emptied into a container. Area 10 is defined by tool side walls 11, base 1 and preferably a stop at 12 to prevent loss of the collected tabs. A handle 13 is suitably secured to base 1 of the tool.

Figure 4:
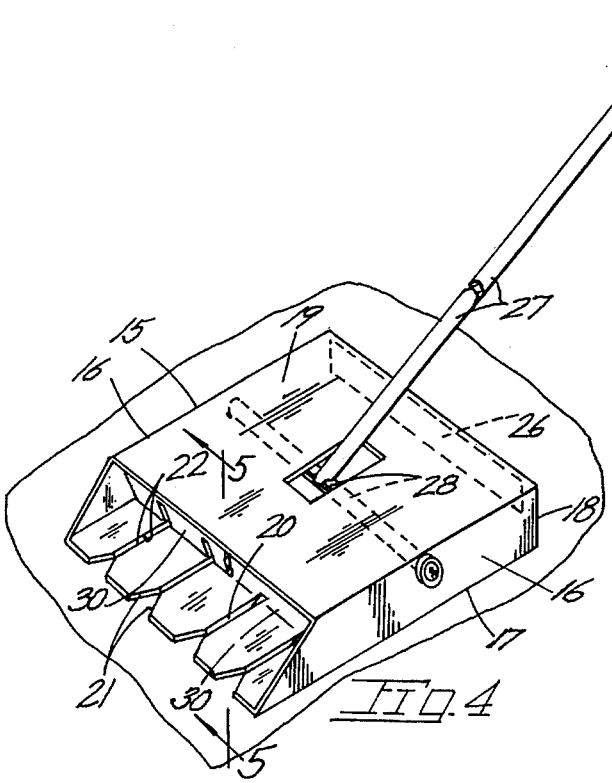
FIG. 4 is a perspective view of a modified form of the tool.
Figure 5:
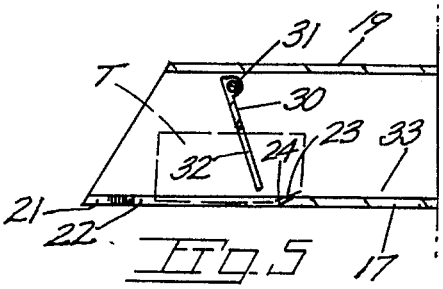
FIG. 5 is a vertical sectional view taken along line 5—5 of FIG. 4.

With attention now to FIG. 4 a modified form of the tool includes a box-like structure 15 having side walls 16, a base 17 and a rear wall 18. Slots 20 in the base plate may be defined by the construction earlier described and including convergent wall segments 21, parallel walls 22, a blade 23 and a cutting edge 24. A rear wall 18 may define an opening 26 for the discharge of a collection of several tabs. A handle 27 is swingably connected to the box-like structure 15 as by a pivotally mounted cross shaft 28. Lifting of the box-like structure permits tab discharge at a container. The modified form of the tool prefereably includes a closure 30 carried by pivot means 31 which permits tab inward passage but prevents accidental loss of severed tabs from a tab collection area 33 of the tool. The closure 30 may be slotted at 32 to permit tab inward passage with minimum displacement of the closure. The closure 30 may be fixedly mounted if the tool includes the discharge opening 26 for the collected tabs. A top wall is at 19.

The present tool is highly useful in the removal of lane marking tabs which are used by the thousands in a typical lane marking installation. In such use, the contractor will be obligated to remove all tabs from a roadway surface upon permanent lane markings being provided.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A tool for severing and removing non-metalic lane markers from a roadway, said tool comprising, a base including a plate for travel in a forward direction along a roadway surface and having at least one open ended slot terminating in one direction at a leading edge of said plate, said slot substantially defined by pair of parallel upright wall surfaces for sliding contact with a marker, a beveled cutting edge defining the rearward terminus of said slot, said base additionally including sidewalls and a rear wall to confine severed markers, and means for imparting forward travel to said base for travel along the roadway surface.

2. The tool claimed in claim 1 including a barrier disposed above said plate to confine severed tabs on said plate.

3. The tool claimed in claim 2 wherein said barrier defines a slot to receive a tab being severed.

4. The tool claimed in claim 2 additionally including pivot means attaching said barrier to said base.

5. The tool claimed in claim 1 wherein said rear wall defines a tab discharge opening.

* * * * *